US006057821A

United States Patent [19]

Hughes et al.

[11] Patent Number: 6,057,821

[45] Date of Patent: May 2, 2000

[54] LIQUID CRYSTAL DEVICE

[75] Inventors: Jonathan Rennie Hughes, St. Johns; David Charles Scattergood, Droitwich; John Clifford Jones, Malvern, all of United Kingdom

[73] Assignees: Sharp Kabushiki Kaisha, Osaka, Japan; The Secretary of State for Defense in Her Britannic Majesty's Government of the United Kingdom of Great Britain and Northern Ireland, Hants, United Kingdom

[21] Appl. No.: 08/856,720

[22] Filed: May 15, 1997

[30] Foreign Application Priority Data

May 17, 1996 [GB] United Kingdom ..... 9610312

[51] Int. Cl.[7] ..... G09G 3/36

[52] U.S. Cl. ..... 345/97; 345/98; 345/99; 345/100; 345/96

[58] Field of Search ..... 345/97, 98–100, 345/96; 340/781–784; 350/333–350

[56] References Cited

U.S. PATENT DOCUMENTS

| | | | |
|---|---|---|---|
| 4,917,470 | 4/1990 | Okada et al. | 350/333 |
| 4,938,574 | 7/1990 | Kaneko et al. | 350/350 |
| 5,011,269 | 4/1991 | Wakita et al. | 350/350 |
| 5,047,758 | 9/1991 | Hartmann et al. | 340/784 |
| 5,206,631 | 4/1993 | Yamamoto et al. | 340/781 |
| 5,555,117 | 9/1996 | Clark et al. | 359/100 |
| 5,646,755 | 7/1997 | Okada et al. | 345/97 |
| 5,731,797 | 3/1998 | Akiyama et al. | 345/97 |

FOREIGN PATENT DOCUMENTS

| | | | |
|---|---|---|---|
| 0337780 | 10/1989 | European Pat. Off. . | |
| 0 397 260 | 11/1990 | European Pat. Off. | G09G 3/36 |
| 0397260 | 11/1990 | European Pat. Off. . | |
| 0464807 | 1/1992 | European Pat. Off. . | |
| 0499101 | 8/1992 | European Pat. Off. . | |
| 0642113 | 3/1995 | European Pat. Off. . | |
| 2064194 | 6/1981 | United Kingdom . | |
| 2077974 | 12/1981 | United Kingdom . | |
| 2118346 | 10/1983 | United Kingdom . | |

OTHER PUBLICATIONS

European Search Report for Application No. 97303366.5; Dated Oct. 16, 1997.

F. Gouda et al., Journal of Applied Physics, vol. 67, No. 1, Jan. 1, 1990, pp. 180–186, "Dielectric Anisotrophy and Dielectric Torque in Ferroelectric Liquid Crystals and their Importance for Electro–Optic Device Performance".

*Primary Examiner*—Richard A. Hjerpe
*Assistant Examiner*—Henry N. Tran
*Attorney, Agent, or Firm*—Renner, Otto Boisselle & Sklar

[57] ABSTRACT

A passive liquid crystal device (FIG. 1) is driven in a multiplexed manner by a strobe signal (STB) applied in succession to a plurality of row electrodes and data signals (DATa, DATb) applied to a plurality of column electrodes. A resultant signal (RESa, RESb) comprising the combination of the strobe and data signals is applied to the pixels in the device. The liquid crystal device is sensitive to the polarity of the resultant signal. Typically a blanking pulse of a first polarity is applied followed by a resultant signal of the opposite polarity. A first data signal (DATa) is intended to change the state of the relevant pixel (SELECT) while a second data signal (DATa) is intended to leave the pixel in the same state (NON-SELECT). According to the invention the resultant signal (RESa, RESb) comprises at least a portion which is substantially continuously varying. This can be achieved by either or both of the strobe and data signals including such a portion or portions. The invention may provide improved performance of the device through maximisation of the torque applied to the molecules of the liquid crystal during the switching process in response to a SELECT resultant (RESa). The invention is particularly applicable to ferroelectric liquid crystal devices (FLCDs).

20 Claims, 16 Drawing Sheets

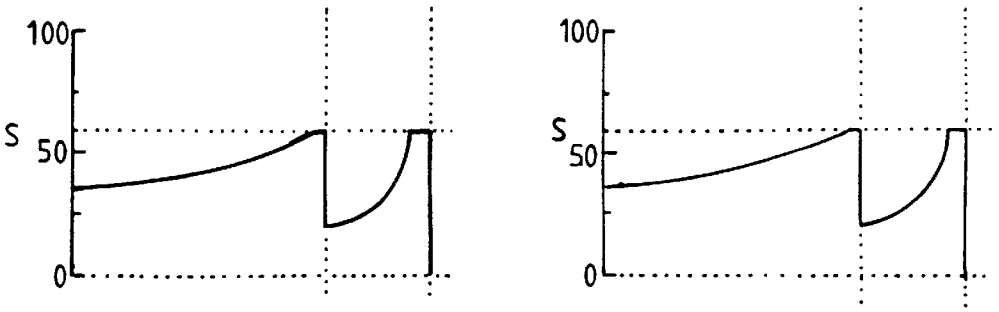
FIG. 14(a)(i)
FIG. 14(b)(i)
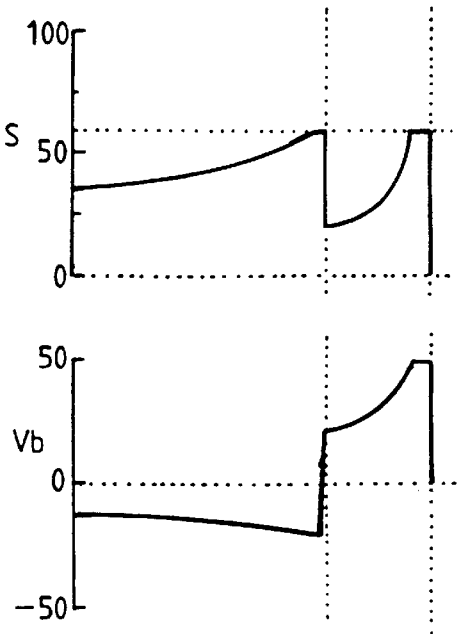
FIG. 14(a)(ii)
FIG. 14(b)(ii)
FIG. 14(a)(iii)
FIG. 14(b)(iii)

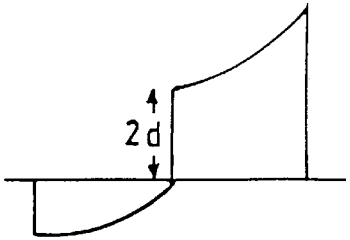
FIG. 18(b)(i)
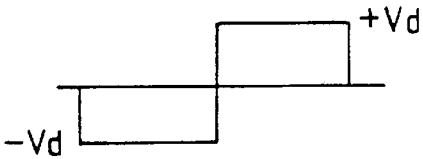
FIG. 18(b)(ii)
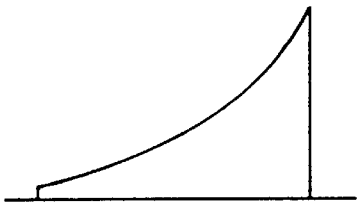
FIG.18(b)(iii)
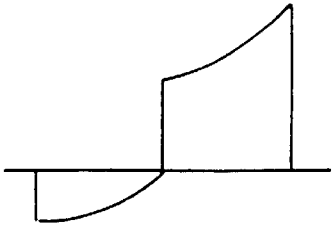
FIG. 18(a)(i)
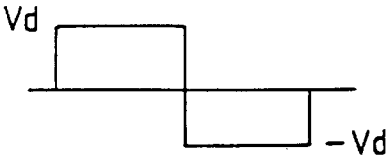
FIG. 18(a)(ii)
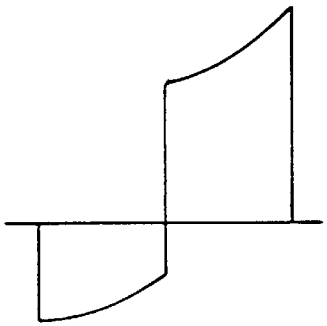
FIG. 18(a)(iii)

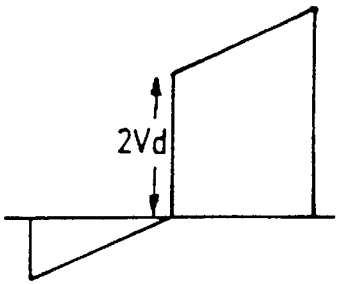
FIG. 19(b)(i)
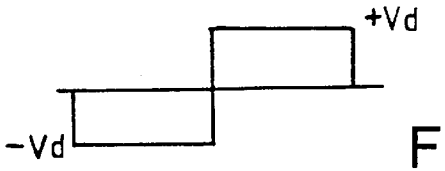
FIG. 19(b)(ii)
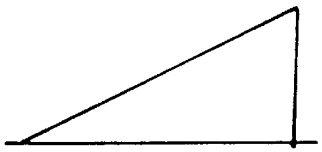
FIG. 19(b)(iii)
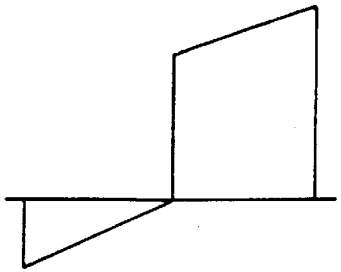
FIG. 19(a)(i)
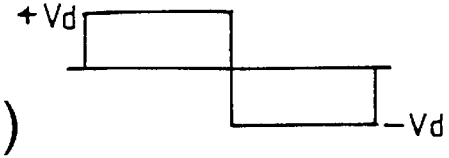
FIG. 19(a)(ii)
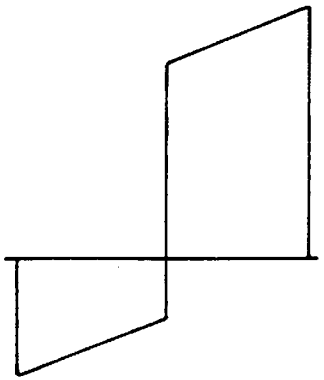
FIG. 19(a)(iii)

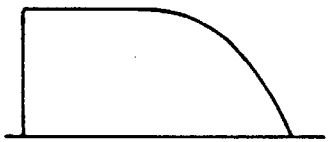
FIG. 20(a)(i)
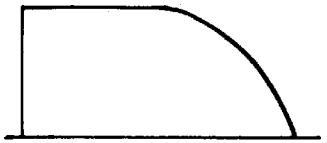
FIG. 20(b)(i)
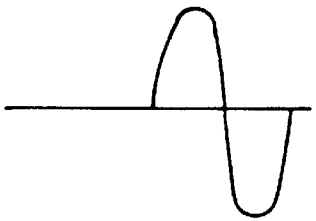
FIG. 20(a)(ii)
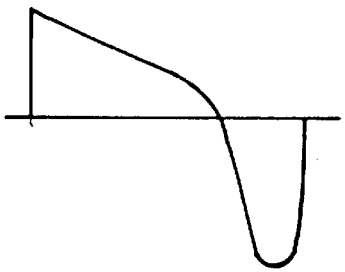
FIG. 20(b)(ii)
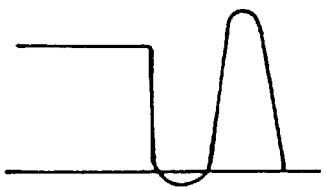
FIG. 20(a)(iii)
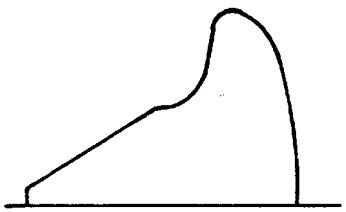
FIG. 20(b)(iii)

LIQUID CRYSTAL DEVICE

FIELD OF THE INVENTION

The present invention relates to a liquid crystal device having a novel driving technique. More specifically, the invention relates to passive liquid crystal devices in which the response of the liquid crystal is sensitive to the polarity of a switching signal. The invention is particularly applicable to liquid crystal devices containing a ferroelectric liquid crystal material and having an array electrode structure for addressing a large number of liquid crystal pixels. The invention further relates to a novel driving arrangement for use with a liquid crystal array device and to a method of driving a liquid crystal device.

BACKGROUND OF THE INVENTION

One type of liquid crystal device to which the invention is applicable is the surface stabilised ferroelectric liquid crystal display (SSFLCD) which can be switched between two states by DC pulses of alternate sign. Such devices, containing ferroelectric liquid crystals in their smectic phase, are of interest particularly because of their speed of switching and their property of bi-stability, in other words they will remain in a particular state in the absence of a particular drive voltage. These devices have traditionally been driven using square wave voltage pulses since these pulses can readily be provided by circuitry of low complexity and have provided adequate performance. One such prior art drive scheme is described in, The "JOERS/Alvey" Ferroelectric Multiplexing Scheme published in Ferroelectrics, 1991, Vol. 122, pp. 63–79 by Gordon and Breach Science Publishers S.A. However, it has been realised that this type of drive technique results in limitations in device performance, particularly with respect to the switching speed between states of the liquid crystal pixels.

It is an object of the present invention to provide a liquid crystal device having a driving technique which ameliorates this drawback.

It is a further object of the invention to provide novel driving circuitry for use with a liquid crystal array to ameliorate the above drawback.

It is a still further object of the invention to provide a method of driving a liquid crystal device that ameliorates the aforementioned drawback.

SUMMARY OF THE INVENTION

According to a first aspect of the present invention there is provided a passive liquid crystal device having a response sensitive to the polarity of an applied signal, the device comprising a layer of liquid crystal material contained between two substrates, electrode structures arranged on the substrates and driving circuitry for applying a switching signal between the electrode structures, at least a portion of which signal has a substantially continuously varying level.

According to a second aspect of the present invention there is provided driving circuit for a passive liquid crystal device which device comprises a matrix of liquid crystal pixels addressable via a plurality of row electrodes and a plurality of column electrodes which device contains a liquid crystal sensitive to the polarity of an applied signal, the driving circuit comprising row driving means for applying a first signal in succession to the plurality of row electrodes and column driving means for simultaneously applying a plurality of second signals, which second signals each comprise one of at least two data signals, to the plurality of column electrodes, wherein at least one of the means for applying a first signal and the means for applying a plurality of second signals provides a signal, at least a portion of which signal has a substantially continuously varying level.

According to a third aspect of the present invention there is provided a method of driving a passive liquid crystal device in which the response of the liquid crystal is sensitive to a polarity of an applied signal, the method comprising applying a signal to a liquid crystal material via electrode structures carried on a pair of substrates, a portion of which signal has a substantially continuously varying level.

All of the aspects of the present invention are based on the realisation that the performance and particularly the switching times of passive liquid crystal devices can be improved by driving the pixels of the liquid crystal device using particular continuously variable signal waveforms rather than square waves. This is especially true of a surface stabilised ferroelectric liquid crystal device (SSFLCD) where a particular signal can be tailored to provide a required torque to be applied to the liquid crystal molecules during the switching operation. The required torque and the driving signal used to obtain it are discussed in detail hereinafter.

The invention is most particularly applicable to a ferroelectric liquid crystal array device which is addressed with a strobe signal applied sequentially to a plurality of row electrodes while a plurality of data signals are applied to the column electrodes of the array during the time that the strobe signal is active for that particular row. The interaction between the strobe signal and the data signals needs to be carefully controlled to ensure that those pixels or cells which are required to be switched are switched successfully and those which are to remain in the same state do not have their state altered by either the strobe signal or data signal applied to them as a result of that signal being used to address other pixels in the array. The switching margin (portion of the switching characteristic that allows the application of different signals to distinguish between switching and non-switching of the pixels between states) becomes particularly critical. This problem is still further exaggerated, for example, by the particular temperature, pixel spacing, alignment and voltage sensitivities of ferroelectric liquid crystal devices. Providing novel drive circuitry or using the novel driving method in accordance with the present invention significantly improves these aspects of SSFLCD display performance.

The driving arrangement in accordance with the invention may also readily provide a number of different data signals which could be used for example to provide a grey scale for the liquid crystal device or to compensate for operational variations in the device as mentioned above.

The novel driving circuitry in accordance with the invention may be arranged to provide the data signals for application to the column electrodes of an array, the strobe signal for application to the row electrodes of an array or both. The driving circuitry may comprise analogue means for providing the continuously varying signals or may comprise a digital arrangement in which the signal is stored digitally in a memory coupled to a digital to analogue converter to derive the output signal. The digital arrangement has the advantage that the range of signal waveforms that can be provided is very extensive and they may readily be changed to suit both different liquid crystal materials and even during operation.

The at least two data signals provided by the invention are preferably both arranged to be DC balanced with themselves. This ensures that there is no net DC voltage across the pixels of an array which voltage might cause dielectric breakdown of the liquid crystal material, undesired movement of ions within the pixel or lead to unwanted switching of pixels into the wrong state. The two data signals may be provided to have different profiles to improve the performance of the liquid crystal device and particularly the switching margin. In most prior art addressing arrangements these two signals have been the inverse of the other but it has been appreciated in accordance with the present invention that it can be desirable to provide data signals having different profiles from one another.

While the present invention is described with reference for ferroelectric liquid crystal devices it is applicable to any passive liquid crystal device in which the response of the liquid crystal is sensitive to the polarity of an applied signal.

BRIEF DESCRIPTION OF THE FIGURES

The present invention will now be described, by way of example, with reference to the accompanying drawings, in which;

FIG. 14 shows graphs of strobe, data and resultant signals to be applied to the row and column electrodes of a device in accordance with the invention.

FIG. 18 shows graphs of strobe, data and resultant signals to be applied to a ferroelectric liquid crystal display device in accordance with the invention.

FIG. 19 shows graphs of strobe, data and resultant signals to be applied to a device which signals are a variation on those shown in FIG. 18, and FIG. 20 shows graphs of strobe, data and resultant signals to be applied to a ferroelectric liquid crystal display device in accordance with the invention in which the data signals differ in shape from one another.

DETAILED DESCRIPTION OF THE PREFERRED EMBODIMENTS

Figure 1:
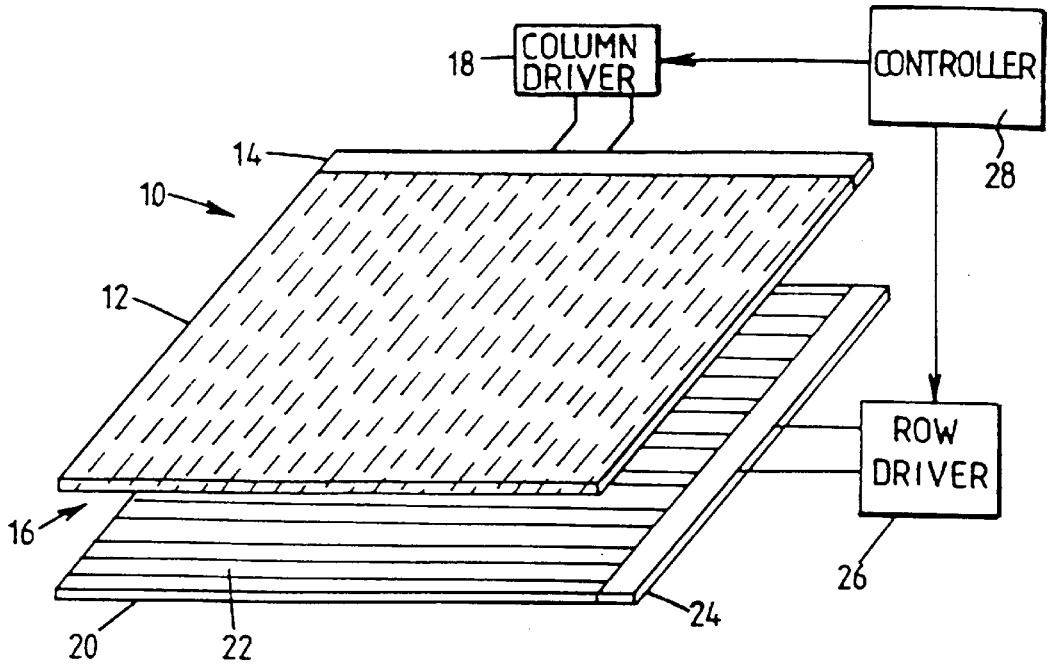
FIG. 1 shows a block schematic diagram of a liquid crystal array device in accordance with the present invention.

FIG. 1 shows a passive ferroelectric liquid crystal array device 10, for example a liquid crystal display device, comprising a first transparent substrate 12 and a second transparent substrate 20 spaced apart from the first substrate by known means such as spacer beads (not shown). The substrate 12 carries a plurality of electrodes 16 of transparent tin oxide on that surface of the substrate that faces the second substrate 20. The electrodes 16 are arranged parallel to one another and each extend between a first edge of the substrate 12 and a second edge at which an electrical connector 14 is arranged to connect each electrode to a column driver 18. The substrate 20 carries a plurality of transparent electrodes 22 also arranged in parallel with one another but at right angles to the electrodes 16 on the first substrate. The electrodes 22 extend from a first edge of the substrate 20 to a second edge at which an electrical connector 24 links them to a row driver 26. Both the row driver 26 and the column driver 18 are connected to a controller 28 which will typically comprise a programmed microprocessor or an application specific integrated circuit (ASIC). Other electrode configurations can be applied to the liquid crystal device to provide, for example, a seven segment display. an r,θ display and so on. The liquid crystal device will also comprise polarising means and alignment layers (not shown) as is known to those skilled in the art. A polariser may be provided at each of the substrates of the device or a single polariser provided in conjunction with a polarising dye placed in the liquid crystal. Alternate electrodes on each substrate of the device may be connected to the row and column drivers at opposite edges of the substrates. The operation of the device will he described in greater detail below.

Figure 2:
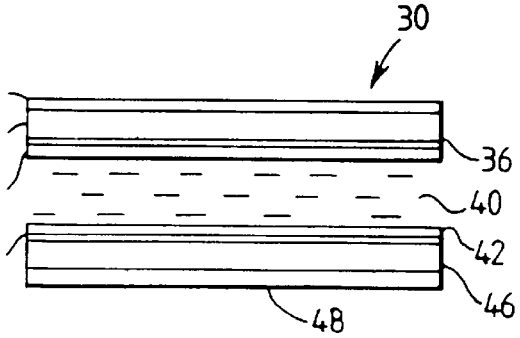
FIG. 2 shows an elevational view of a single pixel within the device shown in FIG. 1.

FIG. 2 shows a simplified example of device in which features such as barrier layer, colour filters and so on are omitted for clarity. A single pixel 30 of the device 10 (FIG. 1) is shown in elevation and comprises, in order from the top of the figure downwards; polariser 32, transparent substrate 34, electrode structure 36, alignment layer 38, liquid crystal layer 40, alignment layer 42, electrode structure 44. transparent substrates 46 and polariser 48. The liquid crystal layer will typically be between 1.5 $\mu$m and 2 $\mu$m in height for a ferroelectric device. The polarisers are arranged to allow the different states of the liquid crystal material to be observed. The alignment layer will typically be a rubbed polyamide layer as is known in the liquid crystal and FLC art. Such a layer may be spun down onto the substrates of the device after the formation of the electrode structures and the layer rubbed consistently in one direction using a soft cloth or other material. This provides the surface stabilisation of the SSFLCD. The direction of rubbing applied to the two substrates may typically be parallel or aligned but facing in opposite directions. Other techniques for alignment such as evaporation of a dielectric, a photo-alignment technique or gratings may be employed. The pixel is defined as the intersection of one of the column electrodes and one of the row electrodes of the array. To use the device as a display it will typically be back-lit by a light source to provide a transmissive mode of operation although a mirror may be provided behind one of the polarisers to allow operation in a reflective mode.

Figure 3:
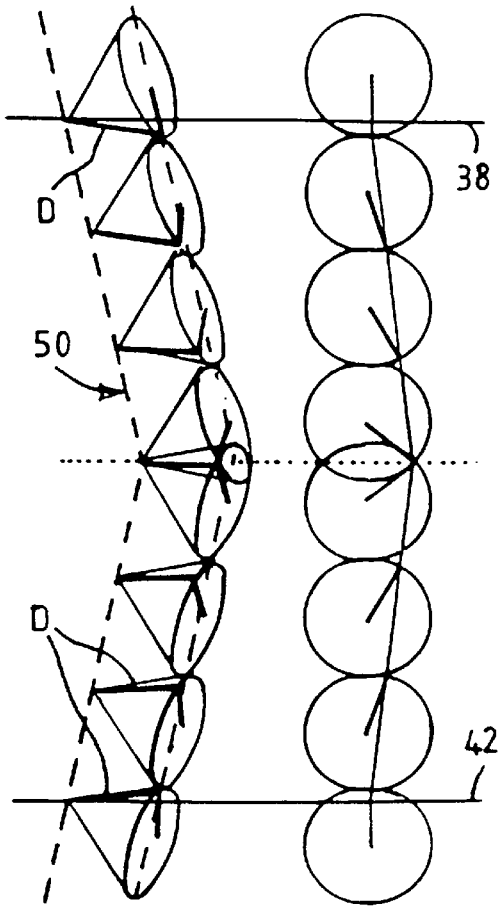
FIG. 3 shows the orientation of ferroelectric liquid crystal molecules between transparent plates in a chevron geometry (C2)

FIG. 3 shows a diagrammatic representation of ferroelectric liquid crystal molecules in a thin pixel such as that shown in FIG. 2 with the rubbing directions parallel. The example shows a material in a smectic C* phase with C2 alignment but the invention is equally applicable to an FLCD in which the liquid crystal is in the smectic C* phase with C1 alignment or for bookshelf uniform tilted layers and so on. Such liquid crystal devices are treated to arrange the liquid crystal material in a smectic phase by heating the device during and after it is filled with the material. The material flows freely into the device while in an isotropic phase and is their cooled slowly through a cholesteric phase and a nematic phase to the optically active smectic C* phase. A variety of liquid crystal materials are known which exhibit an optically active smectic C* phase at ambient temperatures. A ferroelectric liquid crystal material in the smectic C* phase would normally orient itself in a set of helices having a pitch of the order of 100 $\mu$m. By placing the material in a thin device however, the helices are 'unwound' and the directors D of the molecules point in substantially the same direction as shown in FIG. 3.

The ferroelectric material is shown between the upper alignment layer 38 and the lower alignment layer 42 also shown in FIG. 2. As a consequence of the rubbing applied to the two alignment layers strong anchoring forces hold the molecules at the substrates of the device but at greater distances from the substrates, the effect diminishes. In the smectic C* phase with C2 alignment the material aligns itself in a plurality of chevron-shaped layers of which only one is shown at 50. FIG. 3 also shows a plan view of the layer for the sake of completeness. The actual configuration between the substrates of the device is complicated, depending on the alignment and the applied electric field. FIG. 3 shows an example of a material with little or no applied field. For simplicity of the following theoretical considerations we assume a uniform structure in which the director I) is at an orientation $\phi$ throughout the sample.

Figure 4A:
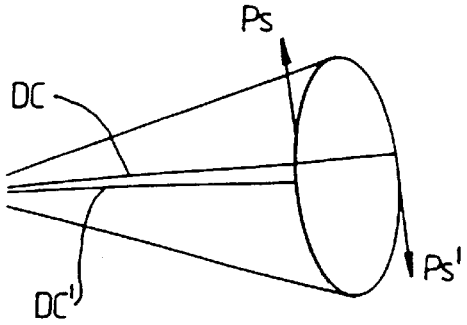
FIG. 4 shows two views of the orientation of a ferroelectric liquid crystal director as it is switched between two stable states.

FIG. 4*a* shows one of the switching cones showing both of the possible fully switched positions DC and DC' of the director The polarisation directors of the molecules, $P_s$ and $P_s'$ respectively, are also shown. In practice, however, as will be discussed below, the director does not occupy these fully switched positions.

Figure 4B:
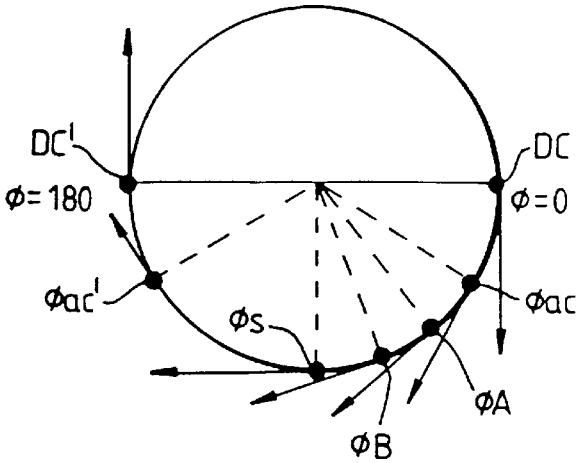

FIG. 4*b* shows a view of the cone from the end thereof (a so-called 'plan view') showing some positions of the director around the cone between position DC to position DC'. Position DC is denoted an angle of $\phi$=0° and position DC' is denoted an angle of $\phi$=180°. Looking at the figure, the director is assumed to rotate around the cone in a clockwise direction under the influence of an applied field of a certain polarity. However, the director of the liquid crystal molecules will only occupy the positions DC and DC' under the continued influence of an applied field of suitable polarity and sufficient magnitude. When such a field is not present the director relaxes around the cone away from the fully switched position to some extent. In this example the director starts from an angle marked $\phi_{ac}$ because this is the position that the director will occupy in use as a result of a constant AC signal applied across the pixel. The AC field is continuously applied us a consequence of addressing the device as an array of pixels and will be explained further below. The angle $\phi_{ac}$ is a function of the distance of the director from the substrates of the device but here we use a uniform director model to assist explanation. Ideally the angles $\phi_{ac}$ and $\phi_{ac}'$ will correspond to angles of ±22.5° in the plane of the device, in other words when the director is viewed normal to the device. When the component of the AC stabilised director orientation in the plane of the device is 22.5° this results in the two AC stabilised positions of the director being perceived as 45° apart which gives the best brightness when crossed polarisers (at 90° to each other) are used with the device.

Another important point on the switching cone is that shown as $\phi_s$ where the director is exactly half way between the two fully switched positions DC and DC'. Once the director has been switched to this point it will continue to move naturally towards DC' (although it will stop at $\phi_{ac}'$) to complete the switching process. Switching occurs when the electric field results in a net torque on the directors lending to change $\phi$. The speed of the switching will depend on the magnitude of the torque and the total change in orientation through which the directors move. Ferroelectric liquid crystal devices switch as a result of a net DC field favouring one side of the cone (either right or left as shown in FIG. 4*b*). If the starting orientation is $\phi_{ac}$ and switching occurs when a net DC field of the correct polarity tends to cause reorientation towards $\phi_s$ (once the director has passed $\phi_s$ the pixel will have latched in the other state and the director will relax to the other side of the cone on removal of the DC field).

Although prior art switching techniques for ferroelectric liquid crystal displays as identified above have used switching pulses of substantially square voltage profile, the present invention is based on an appreciation that the performance of the ferroelectric device may be enhanced by tailoring the switching signal in accordance with the position of the director as it moves. Two of the factors that are most significant in determining the from of the signal are the ferroelectric torque and the dielectric torque which are each related differently to the switching angle of the director and to the applied voltage. In addition the dielectric torque acts in opposition to the ferroelectric torque. This will be explained in greater detail with reference to FIGS. 5*a* and 5*b* below.

Figure 5A:
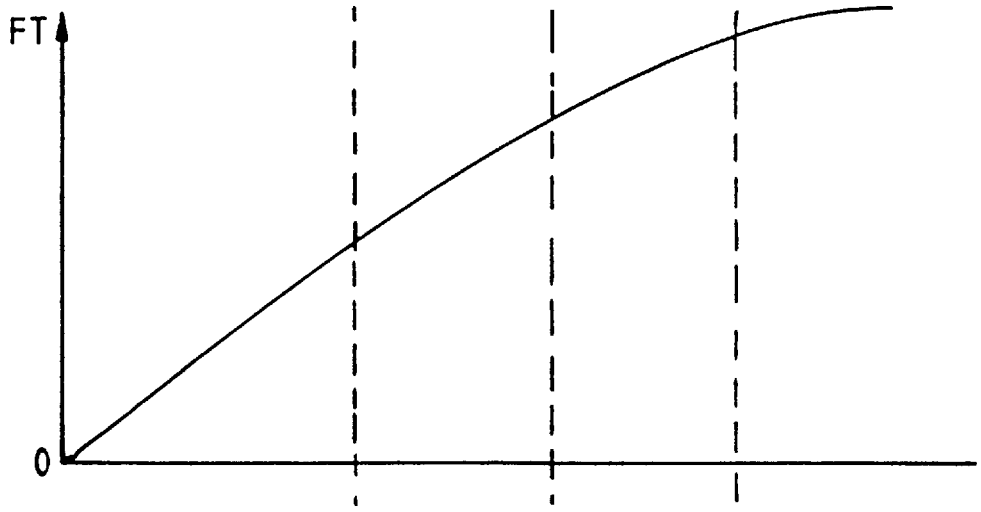
FIGS. 5*a* and 5*b* show general graphs of ferroelectric torque and dielectric torque against switching angle for a ferroelectric liquid crystal device.
Figure 5B:
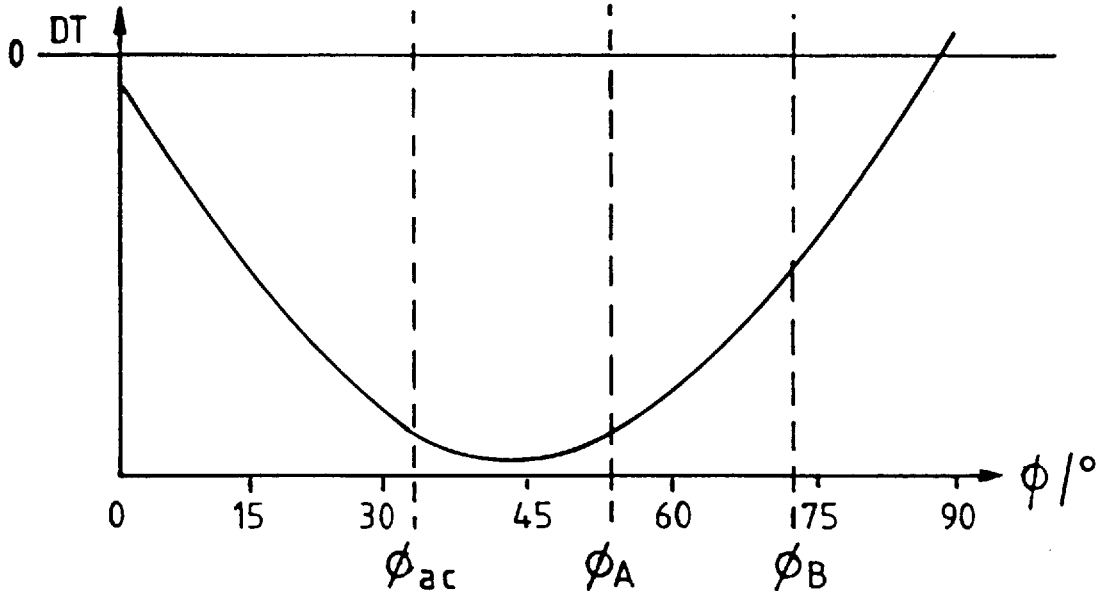

FIG. 5*a* shows the ferroelectric torque acting upon the director plotted against the director positions between DC and $\phi_s$ shown in FIG. 4. The ferroelectric torque is dependent upon the position of the director around the cone as shown in the graph and is also linearly related to the magnitude and direction of the applied field for a particular director orientation. This torque acts on the director to make it rotate around the switching cone. The dielectric, or electrostatic, torque, shown in FIG. 5*b*, results from the ferroelectric material which aims to reduce the electrostatic free energy of the material, usually at a value of $\phi_{ac}$ close to 0° or 180°. The dielectric torque acts to oppose the ferroelectric torque, varies with the position of the director as shown in the graph and is also proportional to the square of the voltage of the applied field. The effects of the two torques must both be considered to provide fast switching of the director when required while not altering the state of the director at other times. For typical ferroelectric materials, the dielectric torque terms ($\epsilon_0$ E$\epsilon$E) are smaller than the ferroelectric torque term ($P_s$E) except when the applied field is large. Thus, as the applied field is increased the switching speed increases until a maximum when the effect of the dielectric torque term reduces the speed of the device. FIGS. 5(*a*) and 5(*b*) are on different scales and are schematic graphs only to illustrate the dependence of the two torque terms upon director orientation.

The resultant torque Γ applied to the director can be calculated mathematically. This has been shown in "The effect of the biaxial permittivity tensor and tilted layer geometry on the switching of ferroelectric liquid crystals" by M. J. Towler, J. C. Jones and E. P Raynes published in 1992 Liquid Crystals Vol. 11 no. 3. An expression for the applied torque (ignoring elastic and inertial torques) is given by:

$$\Gamma = \eta\frac{d\phi}{dt} = P_s\frac{V}{d}\sin\phi - \varepsilon_0\frac{V^2}{d^2}\left[(\Delta\varepsilon\sin^2\theta - \partial\varepsilon)\cos^2\delta\sin\phi\cos\phi - \frac{\Delta\varepsilon}{4}\sin 2\theta\sin 2\delta\cos\phi\right]$$

In which the symbols represent the following, together with values used in the following examples:

| | | | |
|---|---|---|---|
| η | is the switching viscosity of the liquid crystal | taken as | 100 cP |
| $P_\sigma$ | is the ferroelectric spontaneous polarisation | taken as | +5 $nCcm^{-2}$ |
| φ | is the angle of director around the cone | | |
| V | is the applied voltage | | |
| d | is the spacing of the substrates of the device | taken as | 1.5 μm |
| $\epsilon_0$ | is the permittivity of free space | equal to | $8.886 \times 10^{-12}$ |
| θ | is the smectic C cone angle (i.e. the angle between the director and the layer normal) | taken as | 22.5° |
| δ | tilt angle of the layer normal from the substrate | taken as | 0.85θ |
| Δε | is the uniaxial dielectric anisotropy | taken as | −1 |
| ∂ε | is the dielectric biaxiality | taken as | +0.4 |

Figure 6:
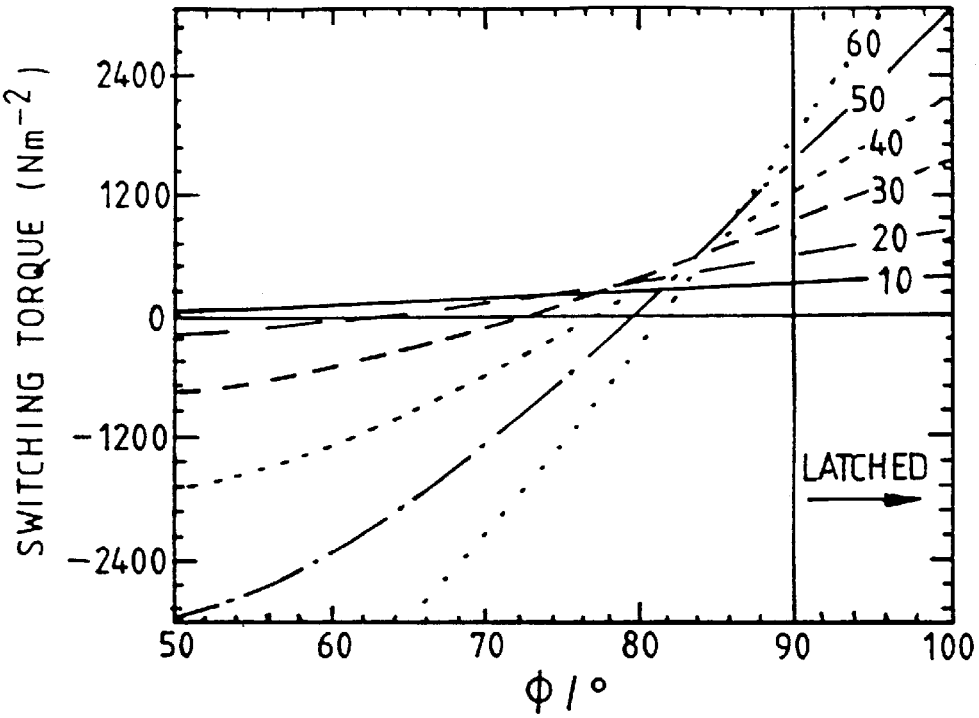
FIG. 6 shows a graph of resultant values of torque against director position for a number of different values of applied voltage for a typical material.
Figure 9:
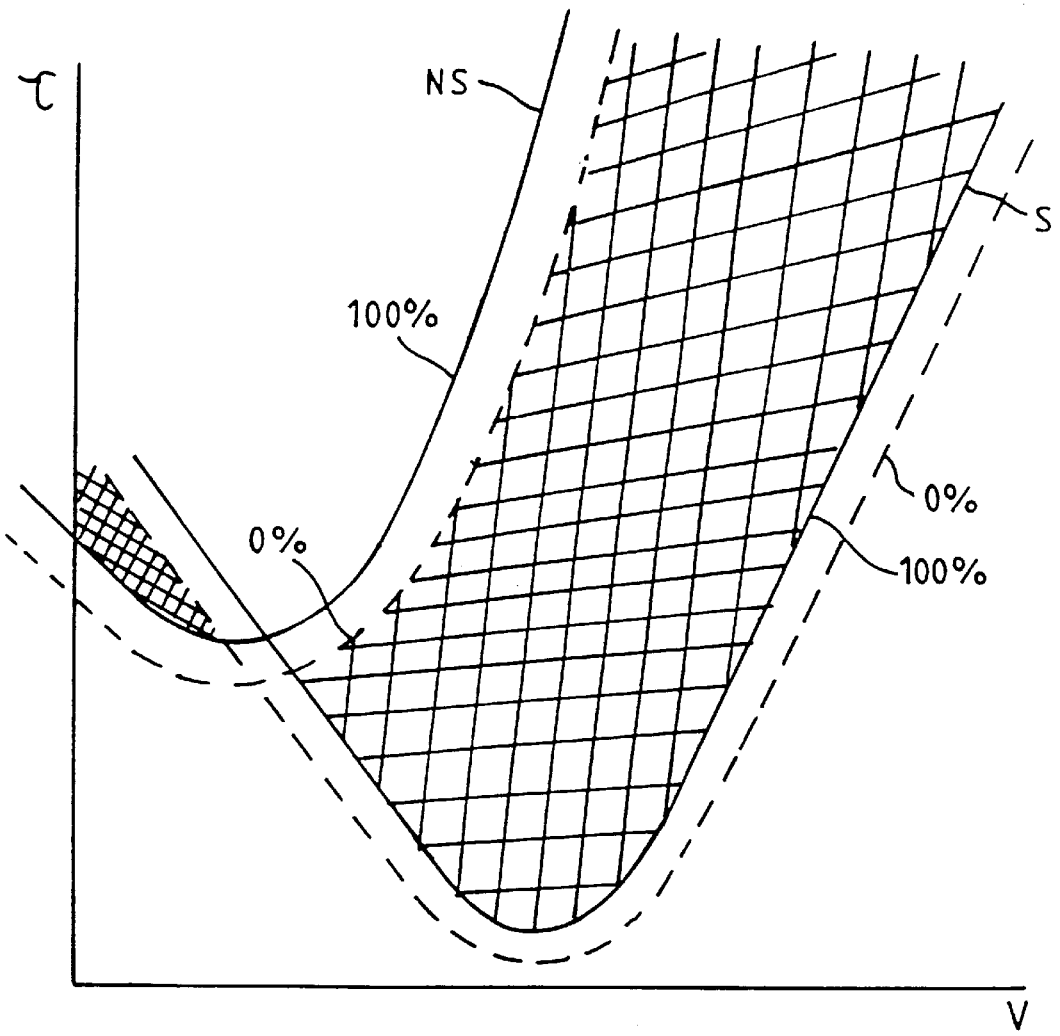
FIG. 9 shows typical $\tau V$ characteristics for switching and non-switching of a ferroelectric liquid crystal display device.

FIG. 6 shows a series of curves (for different applied voltages) of resultant torque against director orientation for a device having the parameter values noted above. The curve corresponding to 10 volt is the shallowest of the curves but corresponds to a positive switching torque Γ at all angles of the director between 50° and 90°. Positive values of Γ cause the director angle φ to move towards 90° whereas negative values cause the director to move towards the AC field stabilised condition $\phi_{ac}$. The higher voltage curves, 20 volt to 60 volt, show that the application of a higher voltage results in a negative switching torque for small values of the switching angle φ. This is the reason that there is a minimum value in the τV curve for certain ferroelectric liquid crystal materials. Above a certain applied voltage, the dielectric torque starts to dominate the switching torque and the pixel will not switch. FIG. 9 and its associated description cover this in more detail.

In the present case, if it is imagined that the director is AC stabilised at an angle of φ=60° then an applied voltage of 10 volt will apply a positive switching torque and the director will start to rotate towards φ=90°. When the director reaches a point at approximately φ=72°, it can he seen from the graph that a voltage of 20 volt will apply a greater torque so the driving voltage can be increased. When the director reaches a point at approximately φ=83° it can be seen from the graph that the applied voltage can be increased substantially, for example to the maximum value of 60 volt shown in the graph. Once the value of φ exceeds 90° the pixel is latched and the driving voltage may be removed. This is the significant part of the switching process for a liquid crystal array pixel since the next row of the array may now be addressed.

The present invention is based upon the realisation that, for a ferroelectric LCD, the switching performance of the device can be improved by varying the voltage level of the switching pulse during the switching process. For a given director orientation there is a switching voltage which gives maximum resultant torque Γ so the discrete example given above can be extended to drive the pixel with a voltage waveform that is substantially constantly varying. The optimum switching voltage can be derived by differentiating the torque equation, setting the result to zero and checking that the second differential is negative. This gives an equation for V as follows:

$$V_{d\Gamma/dV=0} = \frac{P_s d\cdot\tan\phi}{2\varepsilon_0(\Delta\varepsilon\sin^2\theta - \partial\varepsilon)\cos^2\delta\sin\phi - \varepsilon_0\frac{\Delta\varepsilon}{2}\sin 2\theta\sin 2\delta}$$

Where the constituents are as before.

The torque equation can also be used to derive voltages for which there is no torque applied to the directors of the ferroelectric liquid crystal device. This is important to provide discrimination between pixels to be switched and pixels not to be switched a will be described in detail below. Firstly, there is the trivial cast where.

$$V=0$$

and when the ferroelectric and dielectric torques are balanced and in opposition:

$$V_{\Gamma=0} = \frac{P_s d\cdot\tan\phi}{\varepsilon_0(\Delta\varepsilon\sin^2\theta - \partial\varepsilon)\cos^2\delta\sin\phi - \varepsilon_0\frac{\Delta\varepsilon}{4}\sin 2\theta\sin 2\delta}$$

which gives a voltage of double that required to provide maximum torque.

Figure 7:
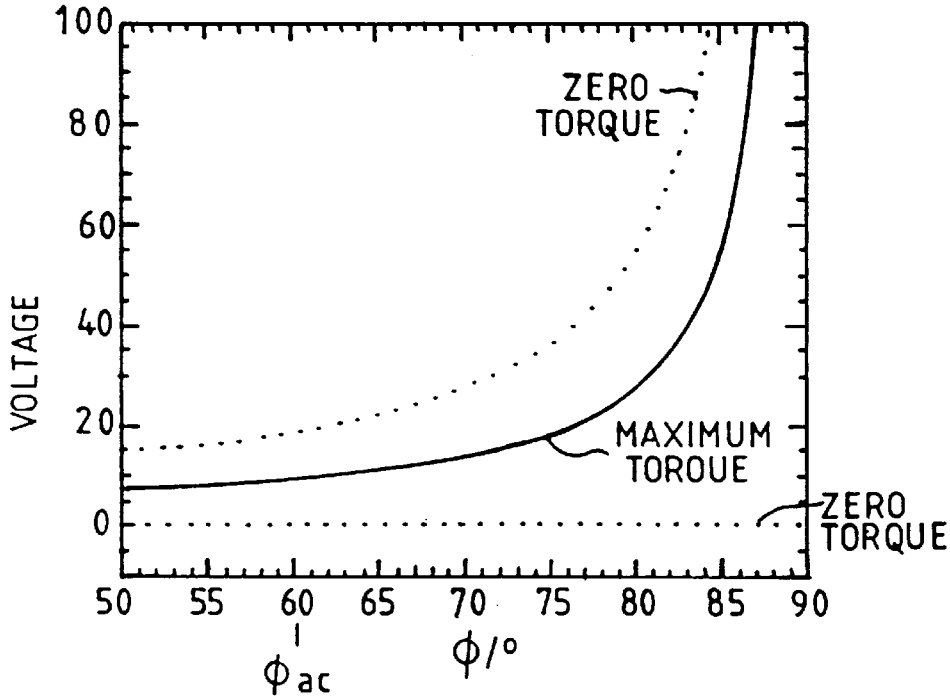
FIG. 7 shows a graph of the director orientation at which the switching torque is a maximum and two graphs for which switching torque is zero with respect to applied voltage and director orientation.

FIG. 7 shows three curves of voltage against director orientation for the case of maximum torque and the two cases of zero torque. The cases of zero torque are important for multiplex addressing of a FLCD. When it is desired for a pixel not to be switched it is important to ensure that voltages applied to the pixel as a consequence of addressing the remainder of the array do not cause erroneous switching. It is important to provide good discrimination between the switching and non-switching signals to ensure that erroneous switching does not occur. The difference between the switching and non-switching voltages should be as great as possible to give wide operating ranges of the device, in terms of temperature, voltage and structural non-uniformities. A prior art multiplex addressing scheme will now be described in order to explain switching and non-switching signals and discrimination between the two.

Figure 8:
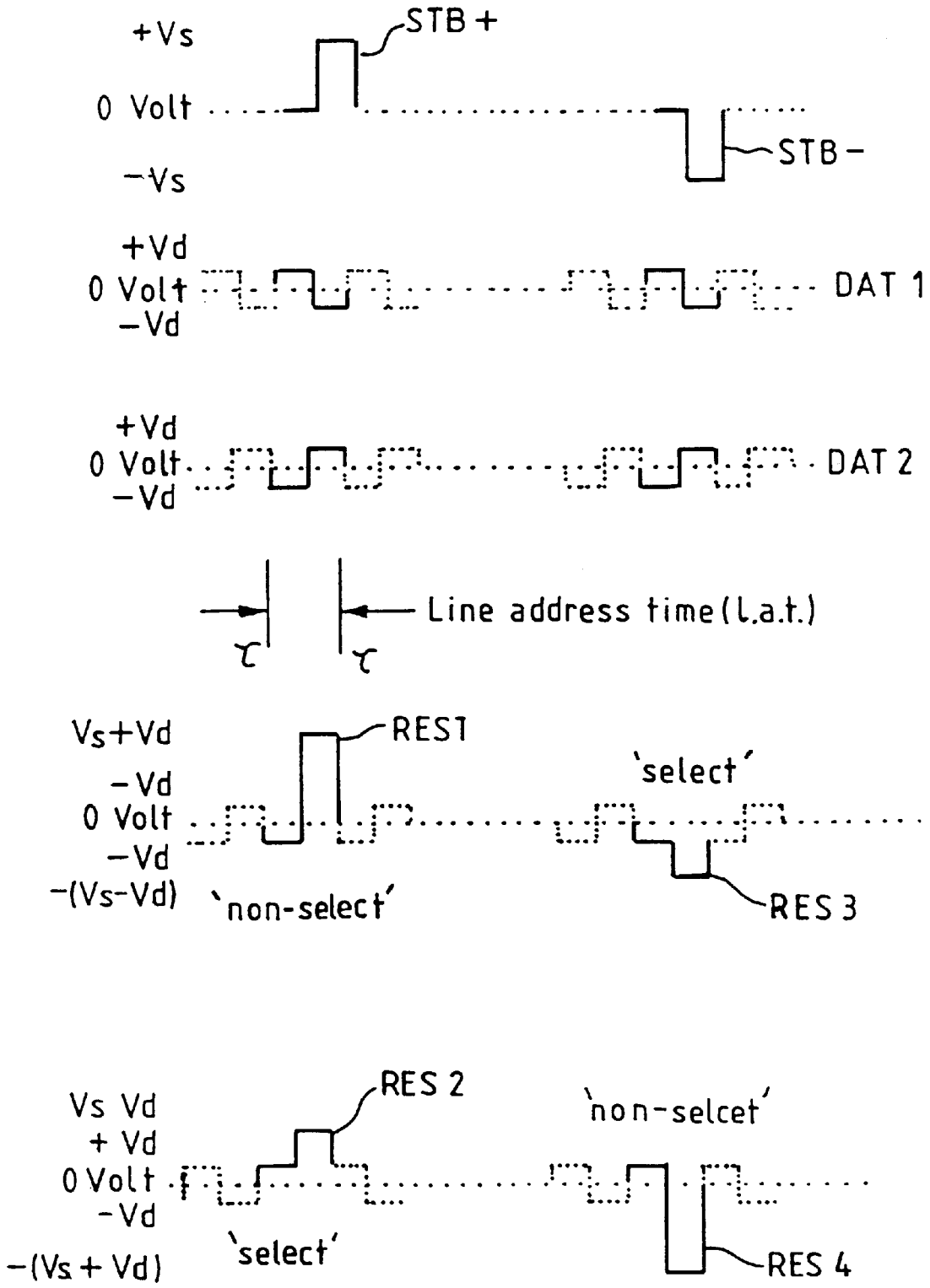
FIG. 8 PRIOR ART
FIG. 8 shows strobe, data and resultant signal waveforms for a prior art addressing scheme using square wave signals.

FIG. 8 shows a prior art monopulse addressing scheme for a ferroelectric liquid crystal array device in which a strobe signal is applied in succession to the row electrodes. The strobe signal comprises a positive going strobe pulse STB+ and a negative going strobe pulse STB−. The strobe pulses each having a period of zero volt followed by an equal period of magnitude Vs. Either of the two data pulses DAT1 and DAT2 having magnitudes of Vd may be applied to the column electrodes as required. While the strobe pulse is applied to a particular row, a column driving arrangement must provide the appropriate data waveform to every column electrode. One of these data signal waveforms, when combined with either STB+ or STB− must cause the pixel to change state while the other data signal waveform combined with the strobe signal must not cause the pixel to change state.

In FIG. 8 the combination of STB+ with DAT1 is shown at RES1 and this provides a NON-SELECT signal. It is important to remember that the voltages of the strobe signal and the data signals must be subtracted to give the resultant signal since they are applied to either side of a pixel. The combination of STB+ with DAT2 results in the signal shown at RES2 and this provides a SELECT signal. Thus by changing the data signal the pixel can either be left in the original state or switched to the state defined (in this example) by a positive-going pulse. The higher voltage signal thus provides non-switching of the pixel state.

The JOERS/Alvey scheme described here (see earlier reference) is best applied to materials with τV minima and works as follows. The strobe voltage includes a zero voltage portion in the first part of the time slot and when this is combined with the data signals it provides a pre-pulse of ±Vd followed by a time slot of voltage Vs±Vd. By operating, the FLC device in a τV minimum mode gives a select resultant signal of (+Vd, Vs−Vd) and a non-select resultant signal of (−Vd, Vs+Vd). The pre-pulse Vd will either start to switch the director D from its initial state towards the DC stabilised state $\phi=0°$ or towards $\phi=90°$ depending on the polarity of the pre-pulse. During the second time slot when Vs is also applied, the director is no longer at its initial position $\phi_{ac}$ but is at position Λ (FIG. 4(*b*)) for the select signal or at $\phi=0°$ for the non-select signal.

This leads to improved discrimination between the switching and non-switching signals and switching of the device then occurs on the application of Vs−Vd but not on the application of Vs+Vd.

To switch a pixel to the other state a strobe pulse STB− of the other polarity is required and this will provide a SELECT resultant signal RES3 with the data signal waveform DAT1 and a NON-SELECT resultant waveform RES4 with the data waveform DAT2. However, this scheme requires that two periods of strobe signal are provided for every row of the device to be addressed. An alternative technique provides a blanking pulse to every row in sequence at a time between 5 and 10 rows ahead of the strobe pulse. The blanking pulse has a large enough voltage-time product to switch all of the pixels in a row to one or other of the states regardless of whether the DAT1 or the DAT2 signal waveform is being applied to each pixel (as a consequence of addressing another row of the device). Thus only one strobe signal needs to be applied to the rows of the device since those pixels required to be dark (for example) are already dark and only those which need to be switched to the light state need to have a SELECT resultant signal applied to them.

FIG. 9 shows a graph of switching time τ against applied voltage V for a typical passive ferroelectric liquid crystal device. The lower pair of curves S (solid and broken lines) relate to the switching resultant signal applied to a pixel and the upper pair of curves NS relate to the non-switching resultant signal. The lower solid curve (100%) gives the minimum time and voltage product required to switch all of the directors within a pixel into the other state. The broken line (0%) beneath it gives the time and voltage product at which the directors in a pixel will just start to switch. As the voltage is increased and the time reduced, however, the non-switching curve becomes significant. This curve gives the minimum time and voltage product for the directors in a pixel not to switch to the other state and is related to the upper curve in FIG. 7. The upper curve shown in broken lines is analogous to that for the switching curve.

Between the switching and the non-switching curve (or more properly the broken curve relating to the time and voltage product at which directors within a pixel will start not to switch) lies the inverted operating region of the device. This area is shaded in coarse hatching in the figure and the larger this region is, the greater the discrimination between switching and non-switching of the device in this operational mode. The switching resultant signal must lie within the operating region and the non-switching resultant signal must lie outside this region. Therefore, the combination of the strobe signal and the non-switching data signal must result in a τV product that falls outside of the operating region. Conversely, the combination of the strobe signal and the switching data signal must result in a τV product that falls within the FS region. A large margin of discrimination is particularly important because the ferroelectric LCD is particularly sensitive to temperature and as the device heats up, the position of the τV switching curves move. The area of inverted operation of the figure discussed thus far is suitable for driving by the JOERS/Alvey driving scheme of GB 2,146,743. The other hatched area in the figure show a so-called conventional mode of operation in which the switching and non-switching resultant signals for driving the device are reversed. The driving waveforms described herein are applicable to operation in this region by reversing the switching and non-switching resultant signals.

Thus, for the fastest switching of the pixels, it is required to provide a resultant signal which leads to maximum torque throughout the switching process for pixels to be latched into the opposite state and a resultant signal which leads to the lowest torque practical for pixels that are to remain unchanged. This can be provided by a combination of data signals and/or a strobe signal that is continuously varying. The strobe signal may be arranged to be a square wave signal and the data signals can be varying, the strobe signal may be arranged to be varying and the data signals may be square wave signals or both the data signals and the strobe signal may be continuously varying.

Figure 10:
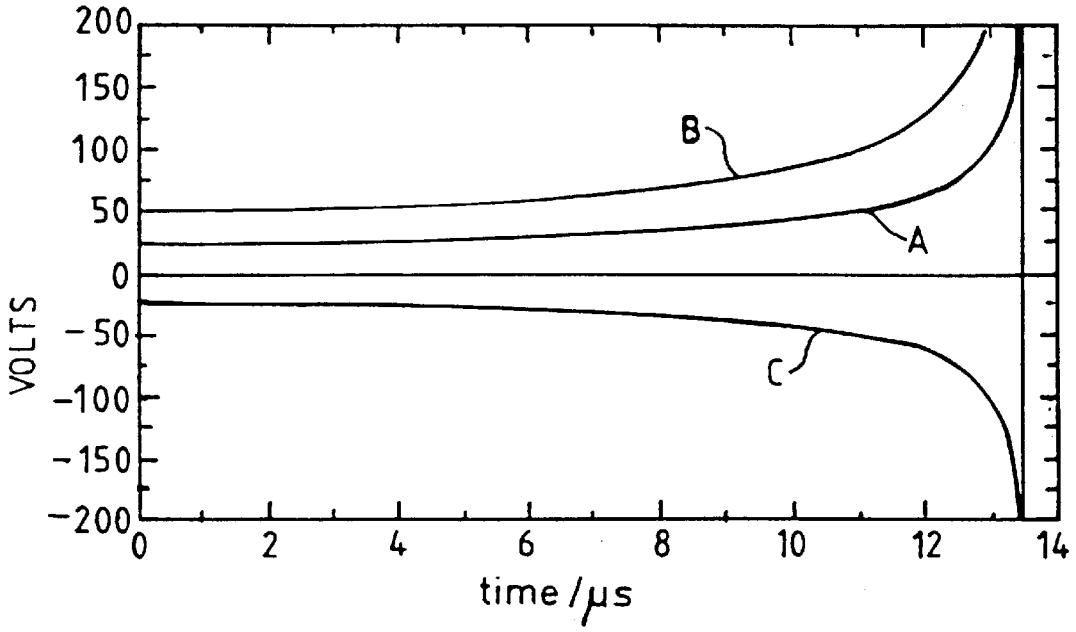
FIG. 10 shows exemplary graphs for a particular material, of applied voltage against time for both switching and non-switching of a ferroelectric liquid crystal pixel illustrating optimum switching torque and zero torque limits.

By using the switching model described above, tie present inventors have used a numerical integration of the torque equation to derive switching voltages as a function of time from the torque versus director orientation expressions. The version of the torque equation used does include an empirical elastic term as given by Towler in Proceeding 163 published together with the previous identified conference reference at pages 403 to 404. This allows the optimum resultant signal to be computed although practical constraints, as will be seen, place some restrictions on the signals actually applied to devices in accordance with the invention. The results of one set of approximations. (using the parameters previously described) is shown in FIG. 10. The curve A represents the voltage to be applied to a pixel for the fastest possible switching. As the director orientation $\phi$ approaches 90° there is a decreasingly small contribution to the torque expression from the electrostatic torque. Consequently, the optimum voltage to be applied is asymptotic to infinity and this voltage clearly cannot be provided in practice. However, the numerical integration results do show that the absolute shortest time for switching of the pixel is 13.4 $\mu$s. By placing a restriction upon the maximum voltage that may be applied, practical switching voltage signals may be derived that provide switching times that only exceed this minimum value slightly. Curve B shows a non-switching resultant curve and curve C shows a voltage signal for generating maximum negative torque. The voltages of curves B and C will not cause the pixel to change state from that state which the applied field of curve A does cause switching.

Figure 11:
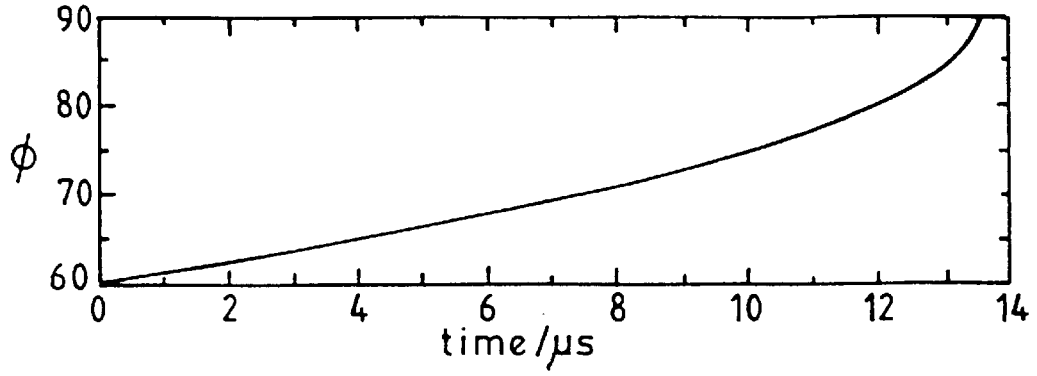
FIG. 11 shows exemplary a graph of director orientation against time for switching a ferroelectric liquid crystal pixel in accordance with the invention.

FIG. 11 shows a graph of director orientation against time derived from the numerical integration calculation. By comparison with FIG. 10 it can be seen that, when the ideal voltage asymptotes to infinity, the director orientation is already very close to a value of 90°. Consequently, the restriction of the applied voltage will only reduce the switching speed very slightly from the theoretical maximum.

Figure 12A:
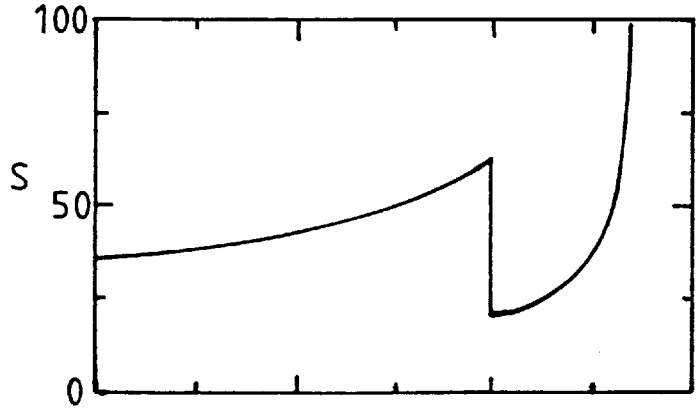
FIG. 12 and 13 show strobe, data and resultant signals in accordance with the invention for switching and non-switching of a ferroelectric liquid crystal pixel respectively.
Figure 12B:
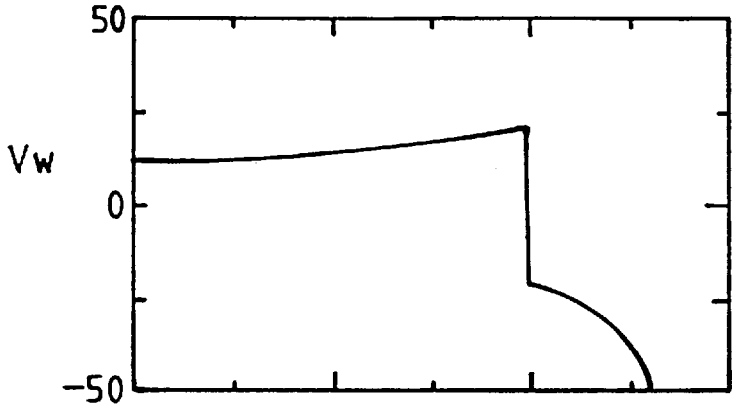
Figure 12C:
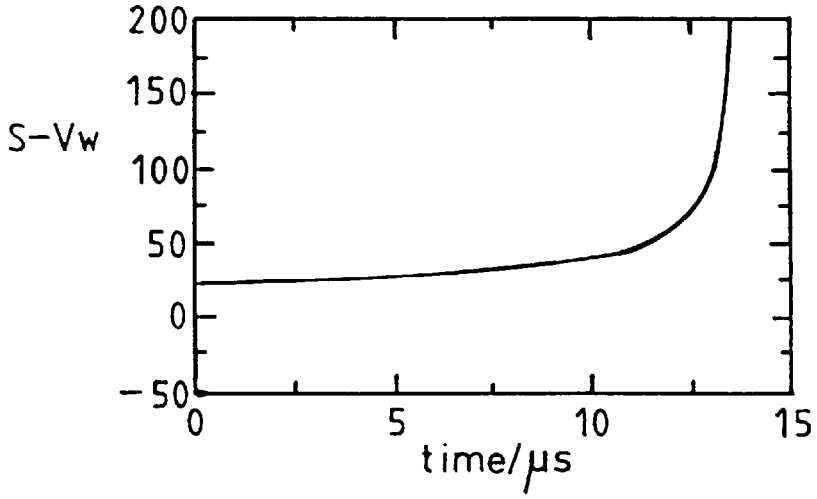

FIG. 12 shows strobe, data and resultant signals based on the curves of FIGS. 10 and 11. FIG. 12(*a*) shows a strobe signal S, FIG. 12(*b*) shows a white data signal Vw ad FIG. 12(*c*) shows the resultant signal for switching S−Vw. The data signal is referred to as a white data signal since the display device is assumed to be blanked to black before the application of the strobe signal to a particular row. Hence the switching data signal is a white data signal and the non-switching data signal is a black data signal. In FIG. 12(*c*) it can be seen that the resultant switching signal corresponds with that shown in FIG. 11 for the voltage signal resulting in fastest switching of the pixel state. Alternatively the display device can be blanked to white and switched to black.

Figure 13A:
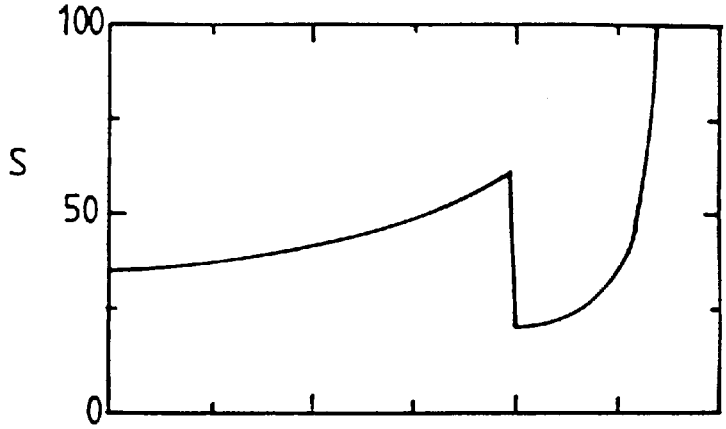
Figure 13B:
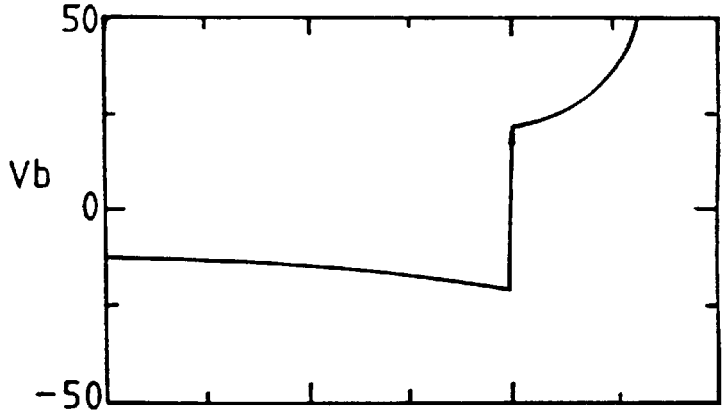
Figure 13C:
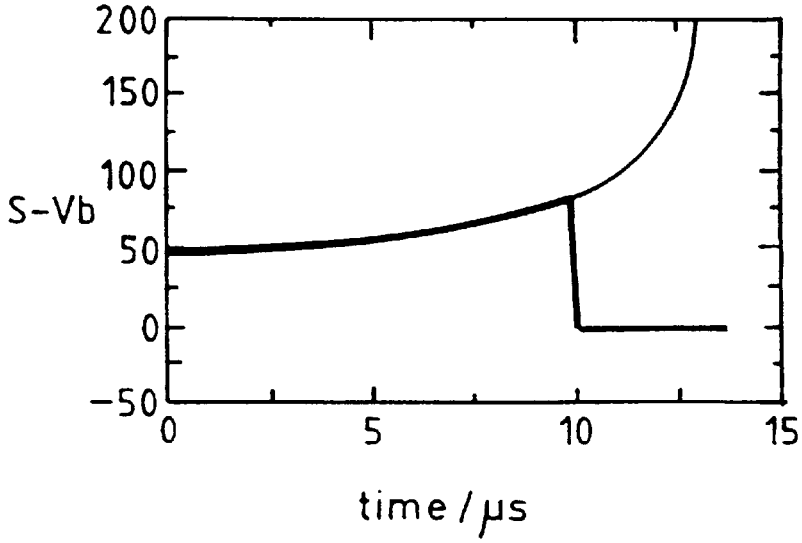

FIG. 13 shows strobe, data and resultant signals for a non-switching or black data signal. FIG. 13(*a*) shows a strobe signal identical to that of FIG. 12(*a*) as it must be for a practical device. The black data signal is shown at FIG. 13(*b*) and is the inverse of the white data signal. Although not essential this is a very effective way of complying with design restrictions placed on these signal waveforms as will be discussed below. FIG. 13(*c*) shows the resultant signal of the strobe and the black data signal. By referring to FIG. 9 it can be appreciated that this signal waveform is of too low a voltage and too short a duration to cause the pixel to change state.

The reason for the form of the data signal waveforms will now be described. Since the data signals are applied continuously to all of the pixels of the device, they must provide no net DC voltage across the pixel. This is to prevent dielectric breakdown of the liquid crystal material, undesired movement of ions within the device or unwanted switching of pixels into the wrong state. This imposes the constraints:

$$\int_0^t Vw(t)dt = \int_0^t Vb(t)dt = 0$$

In addition, the white data and black data waveforms should have equivalent RMS voltages which imposes the constraint:

$$\sqrt{\frac{1}{t}\int_0^t (Vw(t))^2 dt} = \sqrt{\frac{1}{t}\int_0^t (Vb(t))^2 dt}$$

To derive waveforms from that optimum calculated above that meet these constraints requires some compromise. One of the simplest conceivable combinations of strobe and data signals to provide the optimum resultant signal would be to provide a strobe signal equal to half the optimum resultant signal and a non-select data signal identical to the strobe signal and a select data signal equal to the inverse of the non-select data signal This would provide both the optimum switching waveform and a non-select resultant signal having an optimum value of zero. However, this combination of signals does not meet the constraint that the data signals should be DC balanced.

To overcome this difficulty, the non-select resultant signal may be chosen to comprise portions of the high voltage non-select voltage (curve B in FIG. 10) and even arranging for the voltage to be negative to switch the director in the wrong direction (for example curve C in FIG. 10) The curves shown in FIGS. 12 and 13 provide both the optimum switching resultant signal and a non-switching resultant signal that provides a high level of discrimination between the select and non-select resultant signals. Means for applying these desired signal waveforms to a FLCD will be described subsequently.

The driving technique of the present invention uses signals of both positive and negative polarity. For this, the definition of zero volt can be taken as that on a short-circuited element of the device after it has reached equilibrium ("infinite time").

FIG. 14 shows strobe, data and resultant signals derived from those shown in FIGS. 12 and 13. In this example, a voltage limit is applied to both the strobe and the data signals in order to provide a realizable resultant signal. The strobe signal shown at FIG. 14 (i) has been limited to a maximum value of 60 volt and the data signals shown at FIGS. 14 (*a*)(ii) and 14 (*b*)(ii) have been limited to a maximum value of 50 volt. As a consequence, the select resultant signal shown at FIG. 14(*b*)(iii) is slightly longer than the select resultant signal shown in FIG. 12 and includes a short section at the end of the line address time at the maximum value of 100 volt. The extra time required to cause the pixels to change state, however, is very short. The total time to switch the pixels using the signal shown in FIG. 14(*b*)(iii) is 14 $\mu$s is which is only very slightly longer than the theoretical minimum value of 13.4 $\mu$s.

Further compromises may be applied the strobe and data signals of the present invention. For example, the data signals may be subject to lower maximum voltage constraints. The reason that such a limitation in data voltage may be desirable is a consequence of device heating considerations. In effect a large area FLCD presents a load to the driving circuitry that comprises a large number of long RC ladders. The data signals are applied to the device continuously and, since the electrode tracks tend to exhibit quite a high resistance, significant heating of the ferroelectric liquid crystal device can occur. For large area FLC devices, high values of RMS data voltage can cause significant heating of the device. Some compromise, therefore, is desirable for this example and one possible approach is to increase the voltage of the strobe signal to allow lower values of data voltage to be used. Other alterations, for example, using thinner devices, materials having higher biaxialities and/or lower values of spontaneous polarisation will also lower the required data voltages. The drawback of such a compromise is that the non-select resultant voltage would then have a finite switching time and the operating range of the device would be reduced.

For temperature variations of the device the magnitude and/or shape of the strobe and/or data signals may be varied to compensate.

Figure 15:
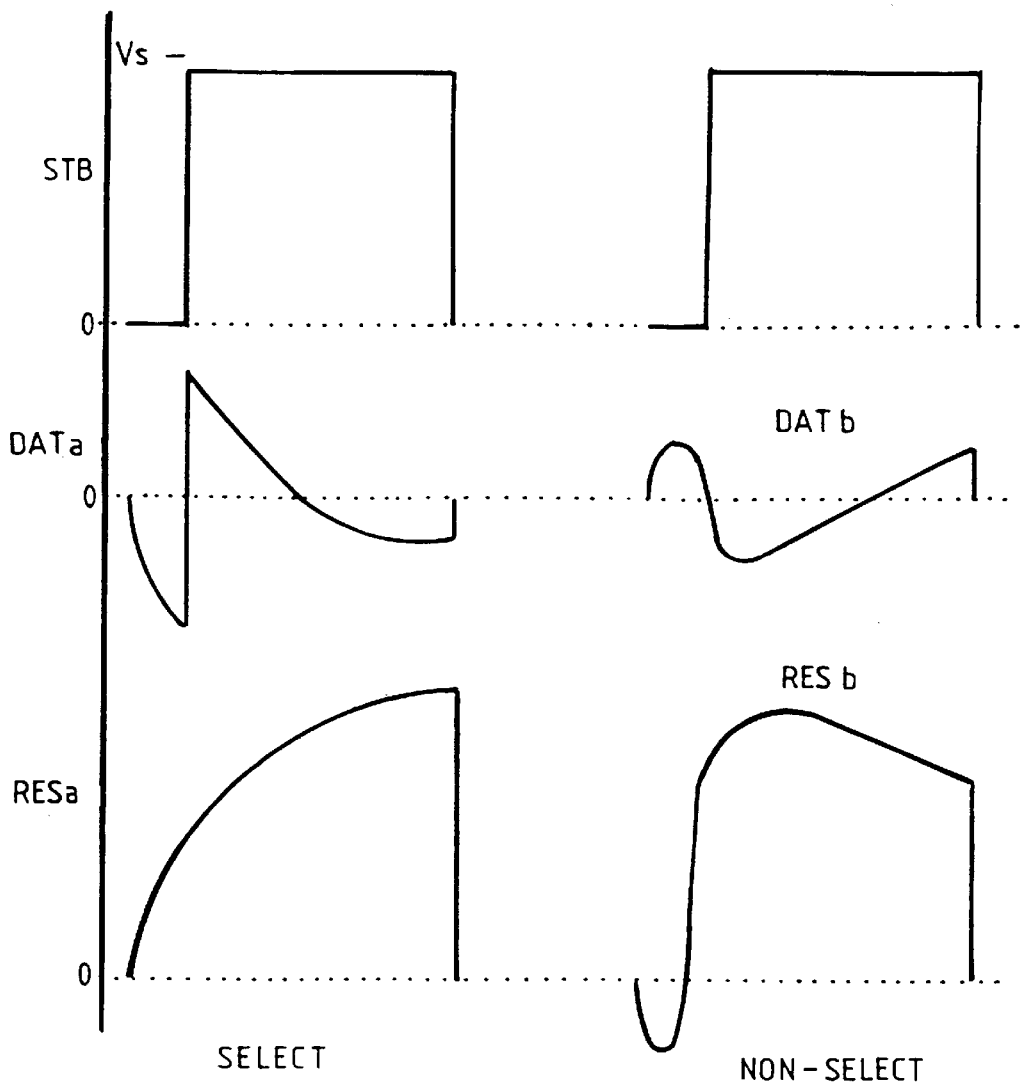
FIG. 15 shows graphs of further examples of strobe, data and resultant signals to be applied to the row and column electrodes of a device in accordance with the invention.
Figure 16:
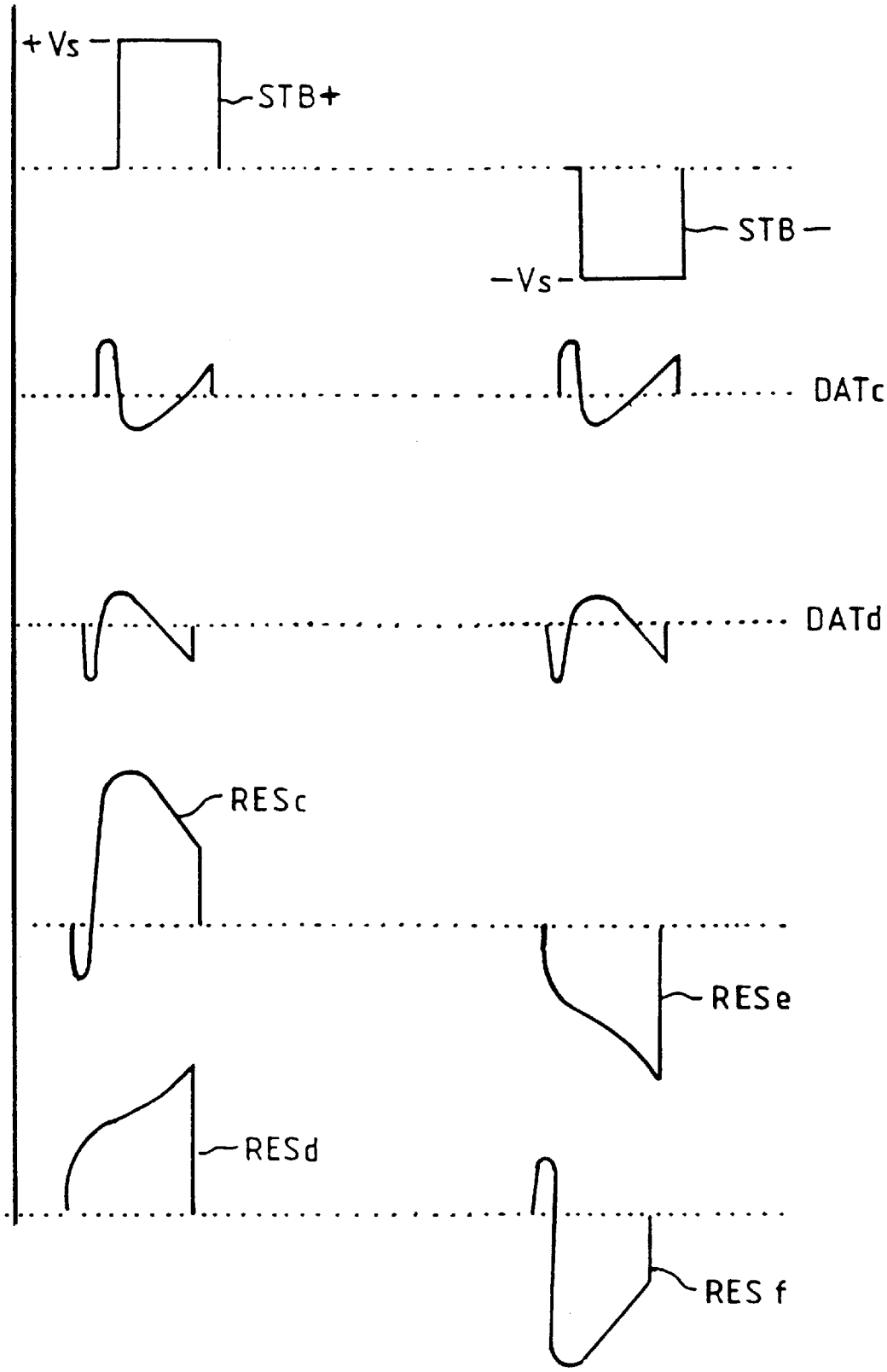
FIG. 16 shows graphs of still further examples of strobe, data and resultant signals to be applied to the row and column electrodes of a device in accordance with the invention.

According to another embodiment of the present invention, a switching technique is described that provides a square wave style strobe signal in combination with a continuously varying data signal. This has the advantage over the previous described embodiment that continuously varying voltage driver circuitry needs only to be supplied for the column drivers of the FLCD providing savings of complexity and cost. FIG. 15 shows a driving scheme for a passive ferroelectric liquid crystal device which provides only a positive-going strobe signal for use in conjunction with a blanking pulse (not shown) as discussed above with reference to FIG. 9. FIG. 16 shows a scheme in which both a positive-going strobe signal and a negative-going strobe signal are provided.

In FIG. 15 a strobe signal STB has a portion of zero volt followed by a rather longer portion of $+V_s$ volt. Data signals DATa and DATb are shown on the line beneath identical representations of the strobe signal STB. Both DATa and DATb are DC balanced a discussed above.

The resultant of the signal DATa when combined with the strobe signal STB is shown as RESa which provides a smoothly increasing voltage across the liquid crystal pixel. This provides a SELECT resultant signal which causes the pixel to change state. The resultant of the signal DATb when combined with the strobe signal STB is shown as RESb which provides a signal shown at RESb. The signal RESb comprises a pre-pulse (during the period at which STB is zero volt) which actually drives the directors in the pixel away from the switching direction as described previously to help ensure that undesired switching of the directors does not take place. The signal RESb then continues to a positive-going peak and smoothly reduces until the end of the strobe signal STB. This provides a non-select resultant signal which leaves the pixel in its original state.

FIG. 16 shows a pair of strobe signals STB+ and STB− which each comprise a section of zero volt followed by a section of magnitude $V_s$. A first data signal DATc is shown beneath both of the strobe signals and on the next line and a second data signal DATd is shown beneath both of the strobe signal on the line below that. The combination of STB+ and DATc gives RESc which comprises a small negative-going pre-pulse followed by a positive-going pulse that peaks and then steadily reduces in voltage until the end of the strobe pulse. The combination of STB+ with signal DATd gives a resultant as shown at RESd with a profile that increases swiftly at first followed by a more gentle increase until the end of the strobe signal. The combination of STB− with DATc provides a resultant signal shown as RESe which is the inverse of RESd. The combination of STB− with DATd provides a resultant signal shown as RESf which is the inverse of the signal RESc.

In common with the signals shown in FIGS. 12, 13, 14 and 15 it can be observed that the data signals in this switching scheme, DATc and DATd, are inverses of one another for the reasons discussed previously. The resultant signals shown in FIGS. 15 and 16 do differ from the optimum signals described but have the considerable advantage that conventional (ie. square wave shape) drive circuitry can be used for the strobe signal.

Figure 17:
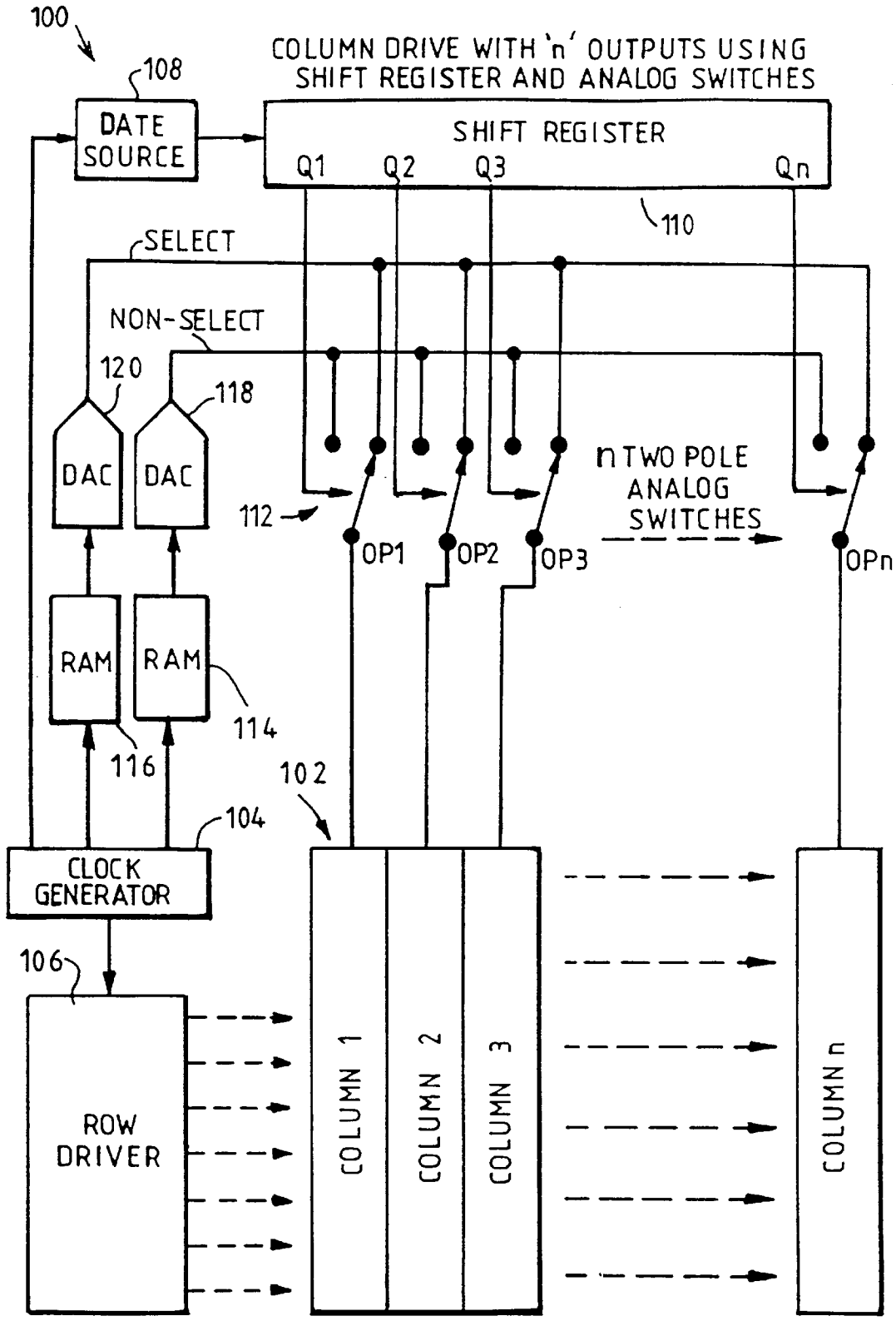
FIG. 17 shows a block schematic diagram of one possible driving arrangement for providing continuously varying signal waveforms in accordance with the present invention.

FIG. 17 shows a block schematic diagram of a driving arrangement 100 in accordance with the present invention. A liquid crystal array 102 comprises a plurality of columns numbered 1 to n of which numbers 1, 2, 3 and n are shown. The driving of the array is controlled by a clock generator 104 which governs the timing of the signals applied to the array. The clock generator 104 is connected to a row driver 106 which is connected to all of the rows of the array to provide the strobe signals at the correct time to the appropriate row.

The clock generator is also connected to a data source 108 which provides the data relating to the desired state of each pixel in a particular row for each application of the strobe signal. A signal from the clock generator 104 clocks this data into a shift register 110 every time that a new row is addressed. The shift register has n outputs Q1 to Qn, in other words one for each column of the display, and each of these outputs controls one of n analogue switches 112. Under the control of the outputs of the shift register 110, the analogue switches couple either a SELECT or a NON-SELECT data signal to their respective columns of the array. The SELECT data signal is provided by a digital to analogue convener (DAC) 120 which is provided with digital data from a random access memory (RAM) 116. The NON-SELECT data signal is provided by a DAC 118 provided with digital data from a RAM 114. The RAM 116 and the RAM 118 contain digitised versions of the SELECT data and NON-SELECT data signals shown, for example, in FIG. 11. The RAMs are addressed by the clock generator 104 providing a parallel signal which counts up at a fast rate to clock the digital signals representing the data signals out of the RAMs. The DACs convert these signals into a pair of substantially continuously varying signals which are applied to respective poles of the switches 112. The relevant data signal is selected from the outputs of the DACs by the plurality of switches 112 and the required combination of strobe signal and data signal waveform can be applied to each pixel in the array. The RAMs must be clocked at a sufficiently high rate and the RAM/DAC combination must be of high enough resolution to mimic the desired switching signal waveform accurately.

The row driver may be arranged to provide a bi-directional strobe signal of the type shown in FIG. 16 or a blanking pulse ahead of the application of the strobe signal. The. blanking pulse is chosen to switch the pixels in a particular row into a given state regardless of the data waveform applied to the pixel at that instant. The blanking pulse is typically applied 5 to 10 rows ahead of the strobe signal. If the blanking pulse is applied too far ahead of the strobe pulse then a disturbance in the display is noticeable to a user while if it is applied too soon before the strobe signal then the directors of the pixels to be switched may well be close to $\phi=0°$ rather than $\phi_{ac}$ and this will cause the switching speed to deteriorate. The blanking pulse may be arranged to comprise a signal having at least a portion of which is a continuously varying signal.

Where the SELECT data waveform and the NON-SELECT data waveform ant inverted versions of each other such as shown in FIG. 16 then the RAM 114 and the DAC 118 can be omitted. In this case the NON-SELECT waveform may be derived from the SELECT waveform by using an inverting buffer connected to the output of the DAC 120. Where the data source 108 can provide the required data in a parallel format, the shift register may be omitted and the data source connected to control the analogue switches 112 directly. The clock generator 104 may also be provided with means to alter the data signals in response to operational data from the liquid crystal device array. For example, it may be desired to change the amplitude and/or the shape of the data waveforms as the array becomes hotter in use. Temperature measurement techniques are known for large area array devices to provide temperature variation details. Temperature compensation can then be readily achieved by providing the data corresponding to the further signals in the RAM and altering the addressing of the RAM to output the modified data signals as appropriate. Further details are available, inter alia, from: International Patent Application Publication number WO95/24715, United Kingdom Patent Publication number GB2207272 and U.S. Pat. No. 4,923,285.

To provide strobe and data signals as shown in FIGS. 12 and 13, it will be necessary to alter the circuitry shown in FIG. 17. In order to apply strobe and data signals which are both continuously varying, a further memory and digital to analogue converter are provided in place of the row driver 106. The memory (for example a further RAM) will contain a digitised version of the strobe signal and will be addressed under the control of the clock generator 104 in an analogous manner to that for the column signals. The digital to analogue converter would convert this data into a continuously varying signal and conventional row driving means could be used to apply the strobe signal to the rows of the array in the correct sequence. Means for providing a blanking pulse may be provided in accordance with known techniques or a further memory and digital to analogue converter may be provided to provide a complementary strobe signal. Where the complementary strobe signal is an inverted version of the other strobe signal, a saving may be effected as described above with reference to the data signals.

Alternatively the present invention may be used to apply a continuously varying strobe signal in conjunction with square wave style data signals. This would provide a compromise similar to that described with reference to FIGS. 15 and 16. A possible scheme is shown in FIG. 18.

FIG. 18(i) shows a continuously varying strobe signal in accordance with the invention. FIG. 18(ii)(a) shows a two-slot non-select data signal as is known from the prior art scheme described with reference to FIG. 8. FIG. 18 (ii) (b) shows a two-slot select data signal which is the inverse of that shown in FIG. 18(i) (a). FIG. 18 (iii) shows the resultant signal where (a) is the non-select resultant and (b) is the select resultant. The non-select resultant has a negative-going pre-pulse followed by a high voltage pulse which does not switch the pixel. The select resultant pulse provides a smoothly increasing switching pulse providing a good approximation to that shown in FIG. 10.

FIG. 19 shows a further example of data, strobe and resultant signals which is a variation on those shown in FIG. 18. FIG. 19 (i) shows a continuously varying strobe signal in accordance with the invention. FIG. 19 (ii) (a) shows a two-slot non-select data signal as is known from the prior art scheme described with reference to FIG. 8. FIG. 19 (ii) (b) shows a two-slot select data signal which is the inverse of that shown in FIG. 19 (i) (a), FIG. 19 (iii) shows the resultant signal where (a) is the non-select resultant and (b) is the select resultant. The non-select resultant has a negative-going pre-pulse followed by a high voltage pulse which does not switch the pixel. The select resultant pulse provides a smoothly increasing switching pulse providing a good approximation to that shown in FIG. 10.

FIG. 20 shows strobe, data and resultant signals in accordance with the invention in which the select (FIG. 20(*b*)(ii)) and the non-select (FIG. 20(*a*)(ii)) data signals differ from one another in shape. These data signals still fulfil the requirements set out previously for the data signals. FIG. 20(*a*)(iii) shows the non-select resultant which comprises a high voltage level initially to exploit the curve B characteristics of a device described with respect to FIG. 10. As the resultant voltage for non-select performance increases, the resultant signal is arranged to have a voltage close to zero to continue to ensure that no significant switching torque is applied to the directors of a device. The switching resultant curve shown in FIG. 20(*b*)(iii) is a close approximation to the ideal switching torque curve A shown in FIG. 10.

It is also possible to provide the appropriate data and/or strobe signals by analogue means although using a digital signal generating an arrangement as shown in FIG. 17 will generally be easier and more flexible.

While of the examples have been concerned with strobe signal waveforms limited in length to a single line address time (l.a.t.), the strobe signal waveform may be arranged to extend into the l.a.t, of the following row as disclosed in UK Patent number 2,262,831.

The examples have concentrated on a passive FLCD device but the invention is applicable to any passive liquid crystal device in which the response depends upon the polarity of the applied signal. Such devices include electroclinic liquid crystal devices (for example in the smectic A* phase), those exploiting flexoelectric effects and some nematic liquid crystal devices.

While embodiments of the invention have been described and claims have been formulated, the present application also relates to any sub-feature or generalisation of combinations of features described herein as will be apparent to the person skilled in the art.

We claim:

1. A passive liquid crystal device having a switching response sensitive to the polarity of an applied signal, the device comprising a layer of liquid crystal material contained between two substrates, electrode structures arranged on the substrates and driving circuitry for selectively applying one of two data signals and a strobe signal to the electrode structures, the data signals consisting of a select data signal for changing the switching state of the device and incorporating a portion of one polarity, and a non-select data signal which does not change the switching state of the device and which incorporates a corresponding portion of the opposite polarity, the switching state of the device being determined by switching and non-switching resultants of the data and strobe signals and at least a portion of each resultant signal having a substantially continuously varying voltage level to provide enhanced switching performance.

2. A liquid crystal device as claimed in claim 1, wherein the switching resultant signal applied between the electrode structures is arranged to provide a substantially maximum value of switching torque over a finite portion of a duration of the signal.

3. A liquid crystal device as claimed in claim 2, wherein the switching resultant signal applied between the electrode structures arranged to provide a substantially maximum value of switching torque is subject to at least one restriction.

4. A liquid crystal device as claimed in claim 3, wherein the at least one restriction is a maximum voltage limit.

5. A liquid crystal device as claimed in claim 2, wherein the non-switching resultant signal is arranged to provide a value of switching torque substantially different from the maximum value over a finite portion of the duration of the signal.

6. A liquid crystal device as claimed in claim 5, wherein the non-switching resultant signal is arranged to provide a resultant torque derived from ferroelectric and dielectric torques which are substantially equal and opposite over a finite portion of the signal.

7. A liquid crystal device as claimed in claim 1, wherein the electrode structures are arranged in a plurality of rows and a plurality of columns to provide a matrix of liquid crystal pixels and the driving circuitry comprises means for applying a strobe signal in succession to a plurality of row electrodes and means for applying a plurality of data signals, which data signals each comprise one of a first data signal and a second data signal, simultaneously to a plurality of column electrodes, wherein at least one of the means for applying a strobe signal and the means for applying a plurality of data signals provides a signal having at least a portion which has a substantially continuously varying level.

8. A liquid crystal device as claimed in claim 7, wherein the first data signal and the second data signal differ from inverses of each other.

9. A liquid crystal device as claimed in claim 7, wherein the means for applying the strobe signal includes means for applying a blanking signal in succession to each of the plurality of row electrodes before the strobe signal is applied to each of the plurality of row electrodes.

10. A liquid crystal device as claimed in claim 9, wherein the means for applying a blanking signal provides at least a portion of said signal having a substantially continuously varying level.

11. A liquid crystal device as claimed in claim 7, wherein the means for applying a strobe signal comprises means for applying different signals simultaneously to at least two adjacent rows.

12. A liquid crystal device as claimed in claim 1, wherein the driving circuitry comprises a digital memory means, a digital to analogue converter (DAC) responsive to values read out from the memory means and clocking means for driving the memory means to provide a succession of values to the DAC.

13. A liquid crystal device as claimed in claim 1, wherein the liquid crystal material has ferroelectric phases.

14. A liquid crystal device as claimed in claim 1 wherein the device comprises a liquid crystal display device.

15. A liquid crystal device as claimed in claim 1, wherein the driving circuitry includes means responsive to temperature variations within the device to alter the applied signal.

16. A driving circuit for a passive liquid crystal device which device comprises a matrix of liquid crystal pixels addressable via a plurality of row electrodes and a plurality of column electrodes which device contains a liquid crystal having a switching response sensitive to the polarity of an applied signal, the driving circuit comprising row driving means for applying a strobe signal in succession to the plurality of row electrodes and column driving means for simultaneously applying a plurality of data signals to the plurality of column electrodes, the data signals consisting of a select data signal for changing the switching state of the device and incorporating a portion of one polarity, and a non-select data signal which does not change the switching state of the device and which incorporates a corresponding portion of the opposite polarity, the switching state of the device being determined by switching and non-switching resultants of the data and strobe signals and at least a portion of each resultant signal having a substantially continuously varying voltage level to provide enhanced switching performance.

17. A driving circuit as claimed in claim 16, wherein at least one of the row driving means and the column driving means comprises a digital memory means, a digital to analogue converter (DAC) responsive to values read out from the memory means and clocking means for driving the memory means to provide a succession of values to the DAC.

18. A driving circuit as claimed in claim 16, wherein both the row driving means and the column driving means provide a signal having at least a portion which has a substantially continuously varying level.

19. A method of driving a passive liquid crystal device having a switching response sensitive to the polarity of an applied signal, the device comprising a layer of liquid crystal material contained between two substrates and electrode structures arranged on the substrates, the method comprising the steps of selectively applying one of two data signals and a strobe signal to the electrode structures, the data signals consisting of a set data signal for changing the switching state of the device and incorporating a portion of one polarity, and a non-select data-signal which does not change the switching state of the device and which incorporates a corresponding portion of the opposite polarity, the switching state of the device being determined by switching and non-switching resultants of the data and strobe signals and at least a portion of each resultant signal having a substantially continuously varying voltage level to provide enhanced switching performance.

20. A method of driving a liquid crystal device as claimed in claim 19, wherein the resultant signal applied via the electrode structures is arranged to provide a maximum value of switching torque over a finite portion of the duration of switching.

* * * * *